US007332700B2

(12) United States Patent
Ishimoto et al.

(10) Patent No.: US 7,332,700 B2
(45) Date of Patent: Feb. 19, 2008

(54) PHOTOMULTIPLIER TUBE WITH DYNODE MODULATION FOR PHOTON-COUNTING

(76) Inventors: Bruce Masato Ishimoto, 3301 Middlefield Rd., Palo Alto, CA (US) 94306; Tim Hawks, 727 Menlo Ave. #1, Menlo Park, CA (US) 94025

( * ) Notice: Subject to any disclaimer, the term of this patent is extended or adjusted under 35 U.S.C. 154(b) by 100 days.

(21) Appl. No.: 11/115,501

(22) Filed: Apr. 26, 2005

(65) Prior Publication Data

US 2005/0247856 A1 Nov. 10, 2005

Related U.S. Application Data

(60) Provisional application No. 60/565,343, filed on Apr. 26, 2004.

(51) Int. Cl.
*H01J 43/04* (2006.01)
*H01J 21/20* (2006.01)

(52) U.S. Cl. ..... 250/207; 250/214 VT; 250/214 R; 313/532; 313/533; 313/103 R; 313/104; 330/42

(58) Field of Classification Search ..... 250/207, 250/214 VT, 214 R; 313/532–536, 103 R, 313/103 CM, 104, 105 R, 105 CM; 330/42
See application file for complete search history.

(56) References Cited

U.S. PATENT DOCUMENTS 4,594,511 A 6/1986 Cooper et al.
4,600,306 A 7/1986 Hara et al.
4,632,550 A 12/1986 Hara et al.
4,840,485 A 6/1989 Gratton
5,151,869 A 9/1992 Alcala
5,196,709 A * 3/1993 Berndt et al. ..... 250/458.1
5,212,386 A 5/1993 Gratton et al.
5,257,202 A 10/1993 Feddersen et al.
5,807,263 A * 9/1998 Chance ..... 600/476
5,818,582 A * 10/1998 Fernandez et al. ..... 356/318
5,981,957 A 11/1999 Cruce et al.
6,177,665 B1 * 1/2001 Wolf ..... 250/207
6,216,021 B1 * 4/2001 Franceschini et al. ..... 600/310
6,317,207 B2 11/2001 French et al.
6,323,495 B1 11/2001 Riedel
6,426,505 B1 7/2002 Rao et al.
6,483,582 B2 11/2002 Modlin et al.
6,518,556 B2 * 2/2003 Staton et al. ..... 250/207
6,542,772 B1 * 4/2003 Chance ..... 600/473
6,673,626 B1 1/2004 Rabinovich et al.
6,690,463 B2 2/2004 Kask
6,741,346 B1 * 5/2004 Gerstner et al. ..... 356/318
6,833,913 B1 * 12/2004 Wolf et al. ..... 356/237.2
2004/0156053 A1 * 8/2004 Wolleschensky et al. ... 356/485

* cited by examiner

*Primary Examiner*—Davienne Monbleau
(74) *Attorney, Agent, or Firm*—Zilka-Kotab, PC

(57) ABSTRACT

In a photomultiplier tube (PMT) device having a plurality of dynodes provided between a cathode and an anode, a cancellation circuit provides two different modulation signals to the PMT to cancel the effects of the modulation signals upon the output of the PMT. For one embodiment, a cancellation circuit includes an input to receive an input modulation signal, a first output to provide a first output modulation signal to a first dynode, and a second output to provide a second output modulation signal to a second dynode, wherein the first and second output modulation signals are 180 degrees out-of-phase. For another embodiment, the cancellation circuit provides the input modulation signal to one of the PMT's dynodes, and also subtracts the input modulation signal from the PMT's output signal.

17 Claims, 2 Drawing Sheets

PHOTOMULTIPLIER TUBE WITH DYNODE MODULATION FOR PHOTON-COUNTING

CROSS-REFERENCE TO RELATED APPLICATION

This application claims the benefit under 35 USC §119(e) of the co-pending and commonly owned U.S. Provisional Patent Application No. 60/565,343 entitled "Cross-Correlation Phase-Modulated Fluorescence Spectroscopy using Photon Counting" filed on Apr. 26, 2004, and incorporated herein by reference.

GOVERNMENT FUNDING

Some aspects of the present invention were funded by the NIH via grant number R43BY014517.

FIELD OF INVENTION

This invention relates generally to photomultiplier tubes (PMT) for photon counting.

DESCRIPTION OF RELATED ART

Recently, non-destructive and non-invasive measurement using light is becoming more and more popular in diverse fields including biological, chemical, and medical fields, for example, use low-light-level measurement by detecting fluorescence emitted from cells labeled with a fluorescent dye. In many clinical testing and medical diagnosis, techniques involving low-light-level measurement such as fluorescence spectroscopy are used. Indeed, observing and measuring fluorophores using phase-modulation or frequency domain techniques have many recognized virtues, among which is the ability to see a distinctive fluorophore decay signature independent of light level or attenuation. In a conventional phase-modulation system, the test sample is illuminated with a modulated light source where the frequency (or frequencies) are chosen based on the lifetime (or lifetimes) of the fluorophores in the sample. The light from the sample is typically detected by a photomultiplier tube (PMT) and the resulting signal is compared in phase and amplitude to the light modulation signal.

For example, a PMT includes a photocathode, an electron multiplier composed of several dynodes connected in a chain, and an anode. When light enters the PMT's photocathode, photoelectrons are emitted from the photocathode. These photoelectrons are multiplied by secondary electron emission through the dynodes and are then collected by the anode as an output pulse. Photoelectrons emitted from the photocathode are accelerated and focused onto the first dynode to produce secondary electrons. However, some of these electrons do not strike the first dynode or deviate from their normal trajectories, thereby causing electrons to have different transit times through the PMT, which in turn may cause the electrons to be multiplied improperly.

Since the modulation frequencies required to detect common fluorophores often vary between tens and/or hundreds of megahertz, it is difficult to accurately resolve phase relationships at these frequencies. Additionally, the PMT typically introduces a statistically random phase delay known as transit-time spread that is compounded by each stage of photon multiplication associated with each dynode electrode in the tube, which is undesirable. Cross-correlation phase-modulated (frequency domain) systems overcome these limitations by additionally modulating the gain of the PMT. The modulation frequency of the light source and the modulation frequency of the PMT are chosen to be different by a small amount (e.g. 100 Hz) such that output of the PMT contains a signal at this difference frequency which can more easily be used to resolve the phase shift due to the fluorophore.

It is well understood that modulating one of the early-stage dynodes in the PMT amplification chain is an effective way to modulate the PMT gain while modulating the photon pulse at a point where the transit time spread is at a minimum, e.g., at one of the earlier dynodes in the dynode chain of the PMT. Accordingly, the second or third dynode in the PMT is typically chosen for modulation, for example, by summing an AC modulation signal at a corresponding point of the dynode's associated voltage divider. While these early-stage dynodes are the most distant from the PMT anode, there is a measurable inter-electrode capacitance between these dynodes and the anode.

For example, FIG. 1 shows a conventional PMT device 100 having a cathode K, an anode P, and a chain 110 of dynodes DY1-DY9 provided between the cathode K and the anode P. The cathode K is coupled to a negative high-voltage source (−HV), and the anode P is coupled to ground potential through a load resistor RL. A modulation signal MOD is coupled to the second dynode DY2. The PMT 100 also includes a voltage divider circuit 120 formed by resistors R1-R11 and extending between −HV and ground potential. Coupling capacitors C1-C3 are provided to minimize the non-modulated dynodes from the modulation signal. The voltage divider circuit 120 provides equal voltage differences between adjacent dynodes, with the exception of those next to the modulated dynode DY2. In this case, the DC voltage at dynode DY2 is set high so that the DC voltage (and thus the gain) between dynodes DY2 and DY3 is reduced. When MOD is driven by an AC voltage source, such as an RF amplifier, during negative excursions (e.g., voltage swings) of MOD, dynode DY2 is driven closer to the point where the voltage differences between each successive pair of dynodes are close to identical, thereby maximizing the gain of the PMT. During positive excursions of MOD, the voltage at dynode DY2 is such that voltage difference between dynodes DY2 and DY3 is small enough to significantly reduce the gain of the PMT 100. Unfortunately, the modulated voltage at dynode DY2 is coupled through the inter-electrode capacitance inherent in the PMT to the anode P, where it is undesirably superimposed on the output.

For another example, in the Hamamatsu R928 PMT, which includes a chain of 9 dynodes, the capacitance between the second dynode and the anode is on the order of 0.2 pF. The total capacitance between the first eight dynodes and the anode is specified by the manufacturer to be 6 pF, while the capacitance between the last dynode (dynode 9) and the anode is 4 pF. With an anode load resistance of 50 ohms and a 15V peak-to-peak modulation signal having a frequency between 10-100 MHz applied to the second dynode, it is typical to observe a modulation signal having a peak-to-peak voltage of 10-100 mV on the anode superimposed on the photon pulse output signal peaks of 3 to 5 mV. When measuring the anode output in a time-averaged (low-pass-filtered) analog mode, this relatively high-frequency modulation signal is rejected early in the signal processing path and doesn't affect the quality of the measurement.

While it is generally recognized that photon-counting is best for low photon flux applications (low light levels) and that modulated PMT cross-correlation phase-modulated systems are a relatively inexpensive and reliable way to measure the lifetimes of common fluorophores, these two techniques haven't been combined due to the fundamental limitations of the inter-electrode capacitance within the PMT itself. The modulation signal feed through can easily swamp the pulse-discriminator circuitry used in photon-counting, making it difficult to obtain any meaningful information. A typical cross-correlation system will need to vary the modulation frequency according to the lifetime of the fluorophore being detected, which will vary the amplitude, phase and frequency of the interfering signal at the anode. Since the output pulses from the PMT have energy primarily in the 100-300 MHz band, a simple high-pass filter on the anode output which significantly attenuates the spurious modulation signal will not preserve the amplitude of the photon pulses; the phase dispersion will suppress the peaks of these pulses below the noise floor.

Therefore, there is a need to provide a cancellation of the modulation signal at the PMT anode over a wide band of frequencies while preserving the shape and amplitude of the photon pulses at the anode.

SUMMARY OF THE INVENTION

A method is described whereby it is possible to modulate the gain of a PMT in a cross-correlation phase-modulated fluorescence measuring system while allowing for photon counting with sensitivity unaffected by the magnitude or frequency of the PMT modulation signal. In the preferred embodiment of the present invention, two modulation signals are applied to two adjacent dynodes of the PMT to both modulate the gain as well as to provide an anode output signal that is free of any significant modulation signal component. In a second embodiment, the modulation signal is applied to a single PMT dynode and to a compensating circuit. The output of the compensating circuit is then subtracted from the PMT anode output signal to provide a signal free of any significant modulation signal component. In both embodiments, the gain of the PMT is modulated by changing the voltage difference between two successive electrodes such that the net voltage capacitively-coupled to the anode is effectively zero.

BRIEF DESCRIPTION OF THE DRAWINGS

The features and advantages of the present invention are illustrated by way of example and are by no means intended to limit the scope of the present invention to the particular embodiments shown, and in which.

Like reference numerals refer to corresponding parts throughout the drawing figures.

DETAILED DESCRIPTION OF THE INVENTION

Embodiments of the present invention are described below with respect to an exemplary PMT device for simplicity only. It is to be understood that embodiments of the present invention are equally applicable to other PMT devices and architectures, both known and yet-to-be developed. In the following description, for purposes of explanation, specific nomenclature is set forth to provide a thorough understanding of the present invention. In other instances, well-known circuits and devices are shown in block diagram form to avoid obscuring the present invention. Further, the logic levels assigned to various signals in the description below are arbitrary and, thus may be modified (e.g., reversed polarity) as desired. Accordingly, the present invention is not to be construed as limited to specific examples described herein but rather includes within its scope all embodiments defined by the appended claims.

Figure 1:
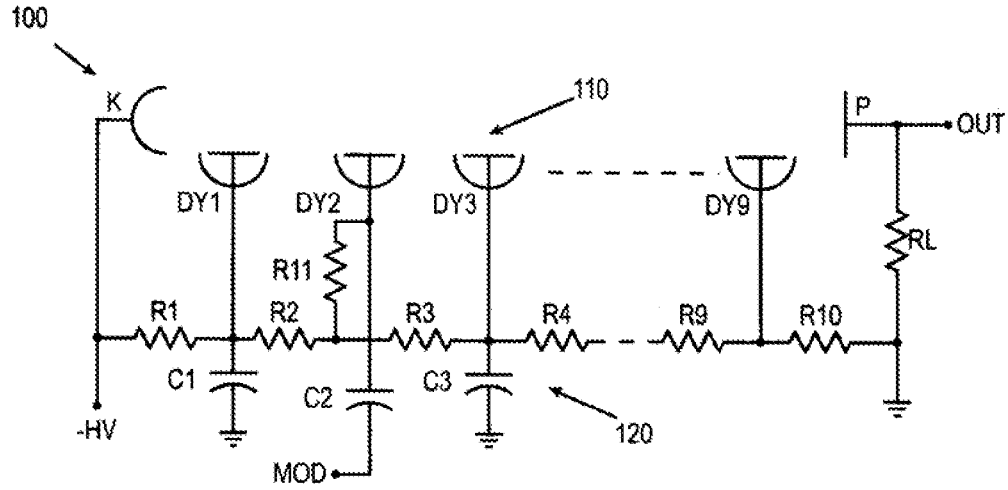
FIG. 1 (PRIOR ART)
FIG. 1 is a schematic diagram of a conventional photomultiplier tube (PMT) device.
Figure 2:
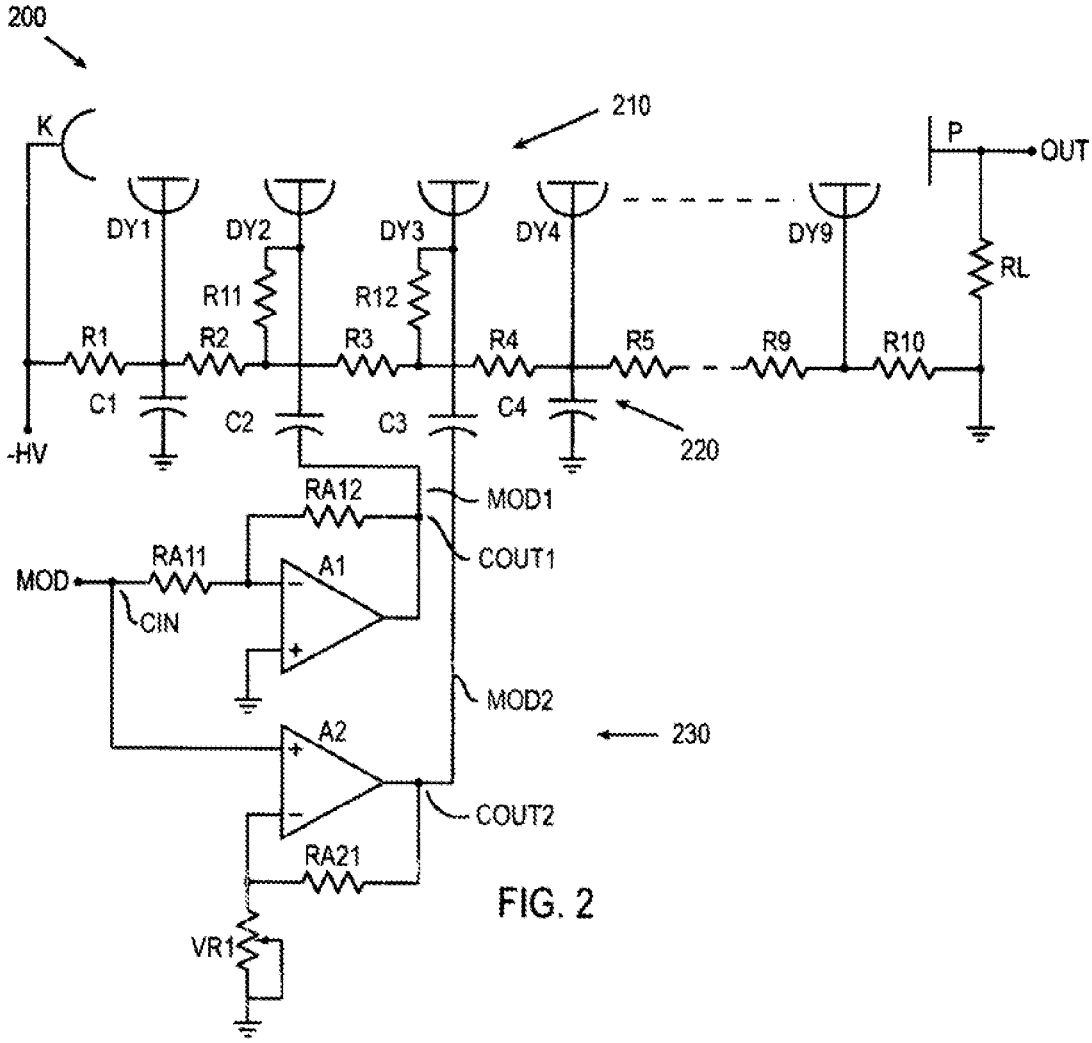
FIG. 2 is a schematic diagram of a PMT device in accordance with one embodiment of the present invention.

FIG. 2 shows a PMT 200 in accordance with some embodiments of the present invention. PMT 200 includes a chain 210 of dynodes DY1-DY9 coupled between the cathode K and the anode P. The cathode K is coupled to a negative high-voltage source (−HV), and the anode P is coupled to ground potential through a load resistor RL. A voltage divider circuit 220 formed by resistors R1-R12 extends between −HV and ground potential. Coupling capacitors C1-C4 are provided to insulate the non-modulated dynodes from the modulation signal MOD. The dynode chain 210 and voltage divider circuit 220 generally operate in a manner similar to that of PMT 100 of FIG. 1, and thus are not further described herein for simplicity.

In accordance with some embodiments of the present invention, the modulation signal MOD is applied to two adjacent dynodes of PMT 200. For example, as shown in FIG. 2, the modulation signal MOD is applied to dynodes DY2 and DY3 via a cancellation circuit 230. However, for other embodiments, cancellation circuit 230 may be used to apply MOD to other adjacent dynodes in PMT 200. Cancellation circuit 230, an exemplary embodiment of which is shown in FIG. 2, modulates the voltage difference between dynodes DY2 and DY3 so that the overall gain of PMT 200 is alternately low and high. More specifically, cancellation circuit 230 provides a first modulation signal MOD1 to dynode DY2 and provides a second modulation signal MOD2 to dynode DY3, where the two modulation signals MOD1 and MOD2 are 180 degrees out-of-phase. By modulating the gain of the PMT (e.g., using out-of-phase modulation signals MOD1 and MOD2), the undesirable superimposition of the modulation signal upon the PMT output signal, as in the case of the prior art PMT 100, may be canceled. Further, for some embodiments, the levels of AC modulation voltage may be adjusted so that the net AC voltage coupled to the PMT anode P is minimized or even eliminated.

For some embodiments, resistors R1 and R5-R10=200 kΩ, R2 and R4=220 kΩ, R3=160 kΩ, R11 and R12=330 kΩ, RL=50 Ω, and capacitors C1-C4=1 nF. However, for other embodiments, other suitable values may be used for the resistors and capacitors that form the voltage divider circuit 220 of PMT 200.

Cancellation circuit 230 includes an input node CIN, two operational amplifiers (op-amps) A1-A2, resistors RA11, RA12, and RA21, a variable resistor VR1, and two output nodes COUT1-COUT2. Op-amp Al has an inverting input coupled to CIN via resistor RA11, a non-inverting input coupled to ground potential, and an output coupled to COUT1. Resistor RA12, which is coupled between the output and the inverting input of op-amp A1, provides negative feedback. Op-amp A2 has a non-inverting input coupled to CIN, an inverting input coupled to ground potential via variable resistor VR1, and an output coupled to COUT2. Resistor RA21, which is coupled between the output and the inverting input of op-amp A2, provides negative feedback. For some embodiments, the wiper (e.g., the control terminal) of VR1 is coupled to ground potential, as shown in the exemplary embodiment of FIG. 2.

An input modulation signal MOD is provided to the input CIN of cancellation circuit 230. In response thereto, cancellation circuit 230 provides a first modulation signal MOD1 to dynode DY2 via output node COUT1, and provides a second modulation signal MOD2 to dynode DY3 via output node COUT2, where MOD1 and MOD2 are 180 degrees out-of-phase. VR1 is provided to adjust the levels of the AC modulation voltage so that the net AC voltage coupled to the PMT anode P is minimized or even eliminated. The gains of op-amps Al and A2 may be adjusted in accordance with the relative capacitances between dynode DY2 and anode P and between dynode DY3 and anode P, respectively. For example, if the capacitance between DY2 and anode P is 0.2 pF and the capacitance between DY3 and anode P is 0.3 pF, then the gain of op-amp A2 should be 0.2 pF/0.3 pF=⅔ of the gain of op-amp A1. The capacitances between the successive dynodes and the anode will generally increase as the order (number) of the dynode increases since each higher-order dynode is increasingly closer to the anode. In any case, the relative voltage gains of op-amps A1 and A2 can be adjusted to accommodate any mismatch in the relative capacitances between various dynodes and the anode P.

For an exemplary embodiment, resistor RA11=200 Ω, resistor RA12=1 kΩ, resistor RA21=1 kΩ, and VR1=1 kΩ, although other values may be used. For other embodiments, cancellation circuit 230 may be replaced by any suitable circuit that provides modulation signals to dynodes DY2 and DY3 which are 180 degrees out-of-phase.

Figure 3:
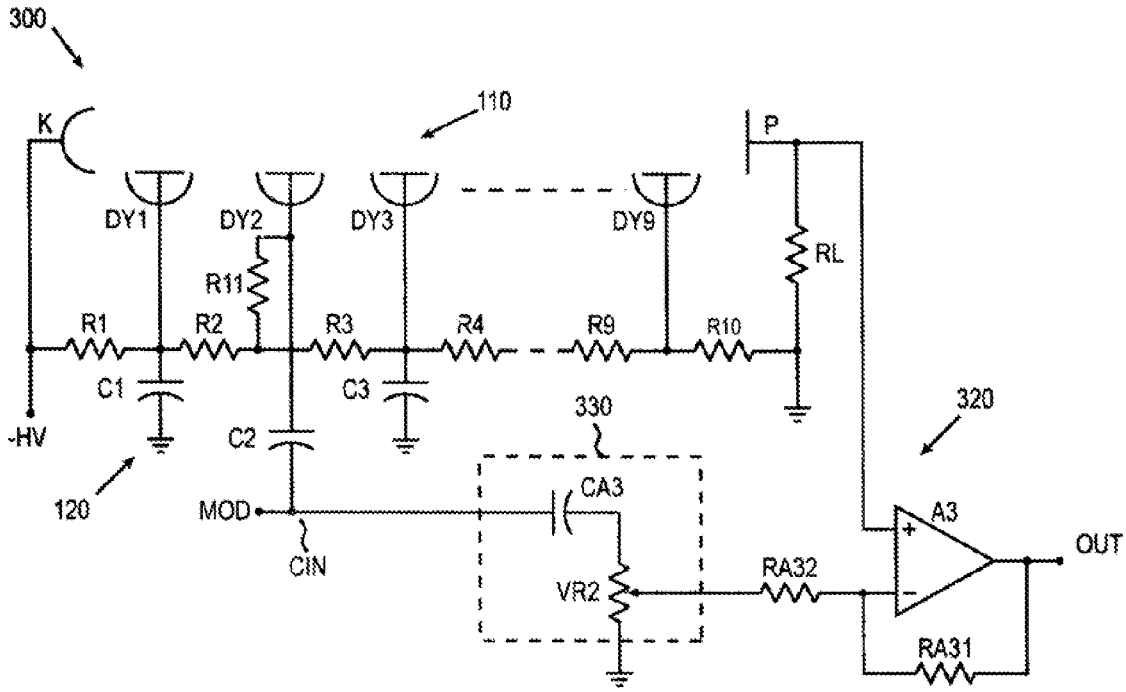
FIG. 3 is a schematic diagram of a PMT device in accordance with another embodiment of the present invention.

FIG. 3 shows a PMT 300 in accordance with another embodiment of the present invention. PMT 300 is generally similar to PMT 200 of FIG. 2, except that PMT 300 utilizes a cancellation circuit 320 that subtracts the input modulation signal MOD from the PMT output signal at the anode P. For the exemplary embodiment shown in FIG. 3, the input modulation signal MOD is applied directly to dynode DY2, and is also applied to an input CIN of cancellation circuit 320. Cancellation circuit 320 includes an op-amp A3, resistors RA31-RA32, a variable-resistor VR2, and a capacitor CA3. Op-amp A3 includes a non-inverting input coupled to the anode P, an inverting input coupled to the wiper of variable-resistor VR2 via resistor RA32, and an output coupled to the inverting input via feedback resistor RA31. Capacitor CA3 is coupled between CIN of cancellation circuit 320 and a first terminal of VR2, which includes a second terminal coupled to ground potential. Together, VR2 and capacitor CA3 form a compensation circuit 330 that, for some embodiments, is part of cancellation circuit 320.

For PMT 300, a single dynode (e.g., the second dynode DY2) is used to modulate the PMT using MOD. Cancellation circuit 320 generates a capacitively-coupled and attenuated form of the modulation signal that is then subtracted from the anode output signal by op-amp A3 to create a PMT pulse output signal that is free of the modulation signal MOD. For some embodiments, op-amp A3 is a high-frequency op-amp, for example, such as a well-known current-feedback amplifier. The compensation circuit 330 formed by capacitor CA3 and VR2 may be effective for lower frequencies where the PMT coupling capacitance can be modeled by a simple lumped capacitance. At higher frequencies, the distributed nature of the capacitance along the transmission lines formed by the dynode lead up through the PMT socket through to the tube and the corresponding path of the anode lead may require modifications to the compensation circuit 330 to achieve acceptable cancellation of the modulation signal from the PMT output signal. In addition, the path length of the signal coupled through the PMT should be matched because any appreciable phase delay therein may hinder cancellation of the modulation signal from the PMT output.

Figure 4:
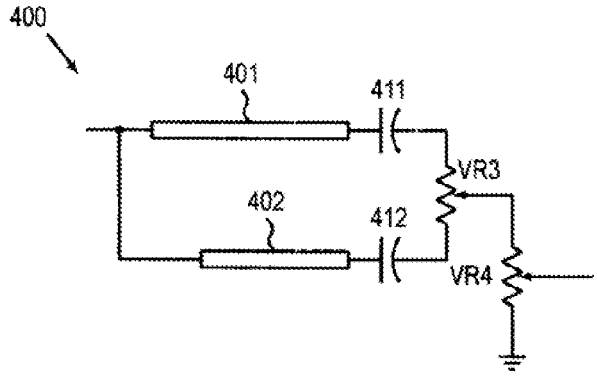
FIG. 4 is a circuit diagram of another embodiment of the compensation circuit of FIG. 3.

FIG. 4 shows a compensation circuit 400 that may be used instead of compensation circuit 330 of FIG. 3. Compensation circuit 400 includes first and second transmission lines 401 and 402. Transmission line 401 and a capacitor 411 are coupled between MOD and a first terminal of a variable resistor VR3, and transmission line 402 and a capacitor 412 are coupled between MOD and a second terminal of VR3. A second variable resistor VR4 is coupled between the wiper of VR3 and ground potential, and has a wiper that may be coupled to the inverting input of op-amp A3 of FIG. 3, for example, via resistor RA32. For some embodiments, the transmission lines 401 and 402 are of different lengths to provide first-order cancellation of the distributed capacitive coupling through the PMT. The propagation delays along transmission lines 401 and 402 should be sufficiently different from each other to provide an adequate range to adjust for various delay paths through the PMT. For some embodiments, capacitors 411-412 are 1 pf, and VR3-VR4 are 10 Ω, although other values may be used.

For both of the compensation circuits 330 and 400, it is to be understood that their capacitances need not match the coupling capacitance of the PMT's tube. Even the pole of the RC networks need not match the pole formed by the PMT coupling capacitance and the anode load resistance. Both poles only need to be high enough in frequency to be well above the modulation frequency and lower harmonics of the modulation frequency.

For an alternate embodiment, the canceling signal created by compensation circuit 330 of FIG. 3 may be instead by synchronously synthesized along with the modulation signal using direct-digital synthesis (DDS) circuitry. However, this canceling signal may need to be more than a simple sinusoid. The high-speed, high-slew-rate amplifier required to drive the PMT dynode with the modulation signal will most likely have non-negligible higher-order harmonics due to distortion that will also need to be cancelled, thereby making the DDS signal generation circuitry quite complex to implement using current technology. Indeed, the passive compensation circuits 330 and 400 described above have the benefit of providing cancellation of these higher-order harmonics. If the distortion of the modulation amplifiers are either negligible or symmetrically identical for positive and negative output excursions, the cancellation circuit 230 of FIG. 2 may provide the best solution because it relies on the intrinsically close matching of the two parasitic modulation signal coupling paths through the PMT, without requiring a compensation circuit having multiple adjustments.

Because there are many different types and configurations for PMT devices, those skilled in the art will recognize that many parameters of the voltage divider and/or cancellation circuits may need to be adapted to accommodate various PMT architectures. Also, there are many different choices of parameters for this surrounding circuitry based on the application and chosen operating parameters. Thus, While particular embodiments of the present invention have been shown and described, it will be obvious to those skilled in the art that changes and modifications may be made without departing from this invention in its broader aspects, and therefore, the appended claims are to encompass within their scope all such changes and modifications as fall within the true spirit and scope of this invention.

What is claimed is:

1. A circuit, comprising:

a circuit component for modulating a gain of a photomultiplier tube in association with one or more dynodes of the photomultiplier tube, utilizing a modulation signal;

a circuit component for generating a matched signal matched to the modulation signal; and a circuit component for combining the matched signal with an anode signal at an anode of the photomultiplier tube to generate a combination signal with a photon pulse amplitude that is preserved;

wherein the modulating, the generating, and the combining are performed for photon-counting.

2. A method, comprising:

modulating a gain of a photomultiplier tube in association with one or more dynodes of the photomultiplier tube, utilizing a modulation signal;

generating a matched signal matched to the modulation signal; and combining the matched signal with an anode signal at an anode of the photomultiplier tube to generate a combination signal with a photon pulse amplitude that is preserved;

wherein the modulating, the generating, and the combining are performed for photon-counting.

3. The method of claim 2, wherein the modulation signal is generated utilizing a cancellation circuit.

4. The method of claim 3, and further comprising a voltage divider circuit having a plurality of resistor stages, each resistor stage coupled to one of the dynodes of the photomultiplier tube.

5. The method of claim 3, wherein the cancellation circuit includes a first output coupled to a first of the dynodes and a second output connected to a second of the dynodes.

6. An apparatus, comprising:

a photomultiplier tube including a cathode, an anode, and one or more dynodes; and a photon-counting circuit coupled to the photomultiplier tube, the circuit for generating a first modulation signal and a second modulation signal 180-degrees out-of-phase with the first modulation signal.

7. The apparatus of claim 6, wherein the circuit includes a cancellation circuit.

8. The apparatus of claim 7, and further comprising a voltage divider circuit having a plurality of resistor stages, each resistor stage coupled to one of the dynodes of the photomultiplier tube.

9. The apparatus of claim 7, wherein the cancellation circuit includes a first output coupled to a first of the dynodes and a second output connected to a second of the dynodes.

10. The apparatus of claim 6, wherein superimposition of a modulation signal upon an output signal of the photomultiplier tube is cancelled.

11. The apparatus of claim 6, wherein the first modulation signal and the second modulation signal are applied to adjacent dynodes of the photomultiplier tube.

12. The apparatus of claim 6, wherein a level of at least one of the first modulation signal and the second modulation signal is adjusted for minimizing a net AC modulation voltage at the anode of the photomultiplier tube.

13. A method, comprising:

providing a photomultiplier tube including a cathode, an anode, and one or more dynodes; and generating a first modulation signal and a second modulation signal 180-degrees out-of-phase with the first modulation signal, for photon-counting.

14. An apparatus, comprising:

a photomultiplier tube including a cathode, an anode, and one or more dynodes including a first dynode with a first modulation signal applied thereto;

a photon-counting circuit coupled to the photomultiplier tube, the circuit for attenuating the first modulation signal, and subtracting the attenuated modulation signal from an anode signal at the anode of the photomultiplier tube;

wherein a path length of the attenuated modulation signal is matched.

15. The apparatus of claim 14, wherein the attenuated modulation signal is capacitively-coupled.

16. The apparatus of claim 14, wherein the circuit includes a cancellation circuit.

17. A method, comprising:

providing a photomultiplier tube including a cathode, an anode, and one or more dynodes including a first dynode with a first modulation signal applied thereto;

attenuating the first modulation signal; and subtracting the attenuated modulation signal from as anode signal at the anode of the photomultiplier tube;

wherein the attenuating and the subtracting are performed for photon-counting, and a path length of the attenuated modulation signal is matched.

* * * * *

UNITED STATES PATENT AND TRADEMARK OFFICE

CERTIFICATE OF CORRECTION

PATENT NO. : 7,332,700 B2
APPLICATION NO. : 11/115501
DATED : February 19, 2008
INVENTOR(S) : Ishimoto et al.

It is certified that error appears in the above-identified patent and that said Letters Patent is hereby corrected as shown below:

In the specification:

Col. 4, line 58, please replace “Al” with -- A1 --.

In the claims:

Col. 8, line 40, please replace “as” with -- an --.

Signed and Sealed this
Thirty-first Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,332,700 B2
APPLICATION NO. : 11/115501
DATED : February 19, 2008
INVENTOR(S) : Bruce Masato Ishimoto et al.

It is certified that error appears in the above-identified patent and that said Letters Patent is hereby corrected as shown below:

In the Specification:

At column 1, line numbers 16-17; please replace "Some aspects of the present invention were funded by the NIH via grant number R43BY014517." with --This invention was made with government support under EY014517 awarded by NIH. The government has certain rights in the invention.--.

Signed and Sealed this
Twenty-fourth Day of November, 2015

Michelle K. Lee

Michelle K. Lee
*Director of the United States Patent and Trademark Office*